United States Patent [19]

Trankle

[11] 4,179,974

[45] Dec. 25, 1979

[54] PERCUSSION ACCESSORY

[76] Inventor: Rick Trankle, 3717 N. Newland, Chicago, Ill. 60634

[21] Appl. No.: 922,555

[22] Filed: Jul. 7, 1978

[51] Int. Cl.[2] ..... G10D 13/08
[52] U.S. Cl. ..... 84/411 P
[58] Field of Search ..... 84/411 R, 411 P

[56] References Cited

U.S. PATENT DOCUMENTS

| | | | |
|---|---|---|---|
| 2,565,225 | 8/1951 | Gladstone | 84/411 P |
| 2,893,283 | 7/1959 | Ippolito | 84/411 P |

FOREIGN PATENT DOCUMENTS

| | | | |
|---|---|---|---|
| 1493136 | 11/1977 | United Kingdom | 84/411 P |

*Primary Examiner*—Lawrence R. Franklin
*Attorney, Agent, or Firm*—Larry L. Saret

[57] ABSTRACT

Two layers of rubber are sandwiched about a layer of metal to provide a surface for practicing drumming. The bottom surface of the bottom layer is roughened to reduce sliding. The device may also be positioned on its side and struck on its opposite side to simulate the striking of cymbals, or placed on the drum surface to dampen undesirable vibrations.

4 Claims, 3 Drawing Figures

PERCUSSION ACCESSORY

BACKGROUND OF THE INVENTION

This invention relates to devices used to practice drumming and, more particularly, to a percussion accessory which can be used as a drum or cymbal practice pad.

Before a performance, or when drums are not available for use, many drummers prefer to warm up or practice on a surface which provides the feel and rhythm, but not the sound, of their instruments. The surface used to practice must have sufficient reiliency or bounce to correspond at least approximately to the bounce obtained from the actual drum and the cymbals, and yet dampen the sound so as not to create an unnecessary disturbance.

In the past, drummers have sometimes used relatively large pieces of rubber upon which to practice drumming. These pieces are usually fairly thick to provide sufficient resiliency and also protect the underlying surface. One device commonly used is wedge-shaped with a smooth bottom surface. The wedge-shape is designed to match the angle at which many drummers place their drums. However, the drummer must be seated or otherwise properly positioned with respect to this practice device in order to use it comfortably. Other devices commonly used include rectangular pieces of rubber fixed to large wood blocks. This design is sometimes preferred over the wedge-shaped devices because they are heavier and tend to remain stationary on the table or other surface on which they are placed when struck, whereas the wedge-shaped devices often slide when struck by the drummer. Also, since the wood block provides weight, less of the rubber is required than with the entirely rubber devices. However, the wood block devices are cumbersome to carry, and the rising price of wood is making these devices expensive to produce as well.

Still another form of practice surface often used is a rubber sheet that fits over all or part of the surface of the drum itself. This variation, of course, can only be used when the drum is available. Furthermore, none of the devices described above can be used to recreate the feel and shimmy of cymbals, which are often played with drums.

Thus, there is a need for, and it is an object of this invention to provide, an inexpensive percussion accessory which is small enough to be easily portable and yet produce the desired bounce for practicing drumming. Also, an object of this invention is to provide a small percussion acccessory which will not move laterally when struck. Yet another object is to provide a drum practice pad which can be struck regardless of the position of the drummer, and can also be used to imitate the feel of cymbals.

SUMMARY OF THE INVENTION

In keeping with one aspect of this invention, a pair of layers of gum rubber are sandwiched about an intermediate layer of metal and are glued to the metal. The outer surface of the bottom layer of rubber is lightly roughened or striated to enhance the gripping ability of the device to the surface on which it is placed. Preferably, the entire device is relatively small and compact enough to be carried in a pocket.

The above-mentioned and other features of this invention and the manner of obtaining them will become more apparent, and the invention itself will be best understood by reference to the following description of embodiments of the invention taken in conjunction with the accompanying drawings.

DESCRIPTION OF THE PREFERRED EMBODIMENTS

Figure 1:
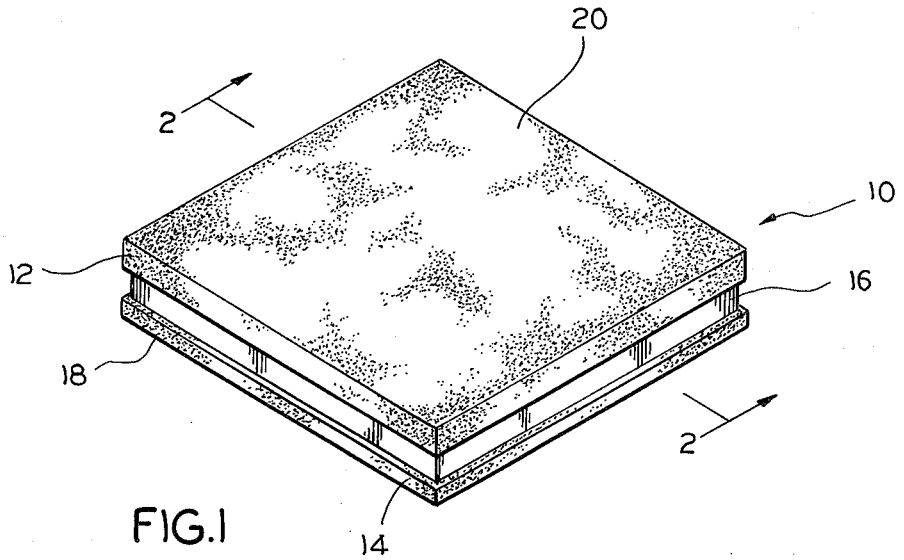
FIG. 1 is a perspective view of a percussion accessory constructed in accordance with this invention.
Figure 2:
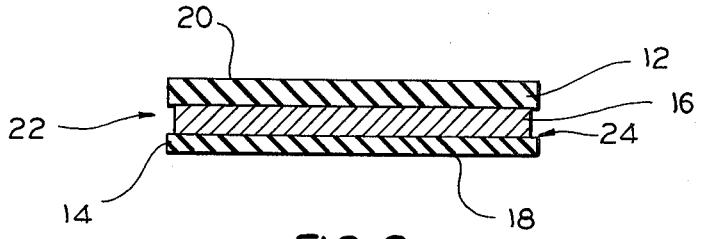
FIG. 2 is a cross-sectional view taken along line 2—2 of the embodiment in FIG. 1.

As shown in FIGS. 1 and 2, a device 10 for practicing drumming constructed in accordance with the teachings of this invention comprises a top first layer 12 and a bottom third layer 14 of resilient material sandwiched about an intermediate second layer 16 composed of a rigid, relatively heavy material. Preferably, the first and third layers are composed of flat sheets of gum rubber or the like, and the second layer is a flat sheet composed of a relatively heavy metal such as steel. The first and third layers 12 and 14 are permanently affixed to the second layer 16 with a suitable adhesive, such as rubber cement.

The outer or bottom surface 18 of third layer 14 is usually placed in contact with a table or other flat resting surface. To promote the gripping ability of the invention and to avoid the lateral movement which is likely to occur when the device is struck with drum sticks, surface 18 is roughened slightly with a wire brush or the like to produce small striations on the surface. These striations are large enough to produce good adherence and yet small enough to avoid substantial machining or waste of rubber. Alternatively, rubber layers with a natural matte finish can be used.

Desirably, a drum practice device 10 constructed in accordance with this invention is small enough to be easily portable, such as in the drummer's pocket. To this end, the first and third layers 12 and 14 are cut to about three or three and one-half inches square. The first layer 12 can be made approximately one-quarter inch in thickness and the third layer can be made approximately one-eighth inch in thickness.

The second layer 16 should preferably be cut slightly shorter in length and width than the first and third layers, and one-quarter inch in thickness so that the first and third layers overhang the second layer. This protects the second layer from scratches and nicks during use. Also, due to the different thicknesses of the three layers, the second layer is closer to the bottom surface 18 of the third layer than to the top surface 20 of the first layer. These dimensions produce the desired quality of bounce and considerably reduce the lateral movement of the device 10 when struck by drum sticks.

If the device is positioned on a flat surface at a right angle to its normal position, so that side 22 rests on the table rather than bottom surface 18, the opposite side 24 can be struck and used to simulate the rhythm and feel of a cymbal. When used in this manner, the first and third layers act as supports, and the device will rock and shimmy like a cymbal but will not fall. This added versatility permits a drummer to acquire a sense of rhythm for the cymbals as well as the drum before the formal performance begins.

Figure 3:
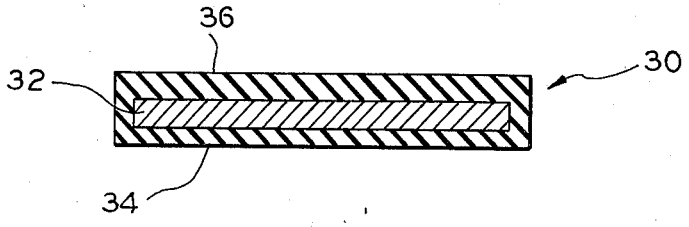
FIG. 3 is a cross-sectional view of a second embodiment of the invention.

An alternative embodiment, as shown in FIG. 3, comprises a generally square or rectangular pad 30 composed of a resilient material with a relatively heavy, rigid layer 32 embedded within the pad. As with the first embodiment, the pad 30 is desirably made of gum rubber and the embedded layer 32 made of steel. The layer 32 generally corresponds to the shape of the pad but is slightly shorter in length and width. It has been found that layer 32 should be positioned less than halfway from the bottom surface 34 to the top surface 36 of pad 30 to provide optimum bounce. This also decreases lateral movement of the pad when struck by lowering the center of gravity. Preferably, bottom surface 34 should also be slightly roughened to reduce sliding of the pad.

An ancillary use and feature of the invention is its ability to function as a damper on the drum. Often, and particularly with a taut drum such as a snare drum, the drum produces a ringing sound after being struck due to secondary vibrations following a beat by the drummer. This sound can be especially undesirable during a recording session when sensitive recording equipment is used. To dissipate and dampen the vibration of the drum, the invention is placed directly on the drum surface. If necessary, the device can be temporarily affixed to the drum surface, such as with adhesive tape. In this manner, the invention will eliminate the undesired ringing sound and yet not significantly affect the available drumming surface or the sound emanating from the drum.

While both of the above embodiments have been described as square or rectangular, the shape of the device or pad is not critical to the invention, and it can be constructed in many other convenient shapes. To obtain all of the advantages of the invention, however, the device should be rectangular to permit the device to rest and be struck on its edge as well as on the top surface.

The many advantages of this device are apparent. First, the components are easily available and inexpensively made. Second, the relatively small size of the invention makes it not only readily portable, but it also improves the drummer's accuracy. Third, the weight distribution and shape of the invention permits the drummer to play at any angle, whether standing or sitting. Fourth, the invention will not slide on a flat surface and is quiet to play. Fifth, the invention provides a natural rebound and a desirable, rhythmic feel similar to either a drum or a cymbal for the musician. Sixth, the invention can also be used to reduce undesirable vibrations emanating from the drum during an actual performance.

While the principles of the invention have been described above in connection with the specific apparatus and applications, it is to be understood that this description is made only by way of example and not as a limitation on the scope of the invention.

I claim:

1. A practice percussion device which simulates the feel of a real cymbal or drum when struck, comprising: a first smooth rectangular layer of resilient material; a second layer of substantially heavier, rigid material slightly smaller in surface area than said first layer and affixed to the center of said first layer so that said first layer extends beyond said second layer on all sides; and a third rectangular layer of resilient material approximately equal in surface area to said first layer and affixed to said second layer so that said third layer extends beyond said second layer on all sides, wherein said device maintains a vertical position when balanced on one edge of said first and third layers and struck on the opposite edge with the ordinary force applied to a cymbal, and resists lateral movement when struck on said first layer while resting horizontally on a suitable surface.

2. The device of claim 1 wherein the first and third layers are composed of gum rubber and said second layer is composed of metal.

3. The device of claim 1 wherein said third layer is approximately one-half the thickness of said first layer.

4. The device of claim 1 adapted to dampen secondary vibrations produced when striking a drum wherein said layers cover less than the entire drum surface area when said accessory is placed on said drum surface.

* * * * *